United States Patent [19]

Fatton et al.

[11] 4,398,831

[45] Aug. 16, 1983

[54] ELECTRONIC WATCH

[75] Inventors: Jean-Claude Fatton, Le Landeron; Jean-Pierre Calame, La Chaux-de-Fonds; Claude Mutrux, Cernier, all of Switzerland

[73] Assignee: Ebauches S.A., Neuchatel, Switzerland

[21] Appl. No.: 352,380

[22] Filed: Feb. 25, 1982

[30] Foreign Application Priority Data

Mar. 5, 1981 [CH] Switzerland ..... 1463/81

[51] Int. Cl.[3] ..... G04C 17/00; G04C 9/00; G04B 19/24

[52] U.S. Cl. ..... 368/76; 368/190; 368/185

[58] Field of Search ..... 368/69, 76, 80, 185, 368/186, 187, 308, 319, 320, 321, 188, 189, 190

[56] References Cited

U.S. PATENT DOCUMENTS

| | | | |
|---|---|---|---|
| 3,975,897 | 8/1976 | Naito | 368/188 X |
| 4,034,551 | 7/1977 | Ushiyama | 368/320 X |
| 4,199,932 | 4/1980 | Berney | 368/80 |
| 4,232,384 | 11/1980 | Jaunin | 368/185 |
| 4,250,572 | 2/1981 | Yoshida | 368/76 X |
| 4,258,431 | 3/1981 | Sekiya et al. | 368/189 X |
| 4,358,837 | 11/1982 | Yamazaki et al. | 368/190 X |

FOREIGN PATENT DOCUMENTS

| | | |
|---|---|---|
| 1518769 | 7/1978 | United Kingdom . |
| 2019049 | 10/1979 | United Kingdom . |

*Primary Examiner*—Joseph V. Truhe
*Assistant Examiner*—Terrance L. Flower
*Attorney, Agent, or Firm*—Philip M. Hinderstein

[57] ABSTRACT

The watch comprises an oscillator, a frequency divider, display means capable of displaying at least hours and minutes, and a correction circuit controlled by a rotary time setting stem which is capable of assuming at least two axial positions, one being a rest position which is occupied by the stem when the watch is functioning normally and an operative position for jointly correcting the minutes display and the hours display. The correction circuit is so arranged as to provide for correction of hours display alone in response to a particular rotary movement of the stem in its rest position.

This particular rotary movement may comprise, in regard to the stem, rotating at least through a minimum angle in a time interval which is less than a predetermined period, for example at least two revolutions in less than two seconds. The minutes and hours displays are changed and the hours display is corrected in the forward direction or the backward direction depending on the direction of rotation of the stem.

8 Claims, 9 Drawing Figures

ELECTRONIC WATCH

BACKGROUND OF THE INVENTION

The present invention concerns electronic watches and more precisely those in which correction of the time display is effected by means of a manual rotary control member such as a time setting stem. It applies more particularly to analog display watches in which the display members, for example hands, are driven by a stepping motor, because it is in this case that the invention provides the most advantages, although it can also be useful in digital or pseudo-analog display watches.

In electronic watches comprising at least an hours hand and a minutes hand, which are driven by a stepping motor, the time display is generally corrected mechanically by means of a time setting stem having two axial positions. Very often, in the same way as in conventional mechanical watches, rotating the stem in one direction or the other, in the position in which it is pulled out, makes it possible to correct minutes and hours at the same time, with the pushed-in position of the stem being a rest position in which rotary movement of the stem does not have any effect.

Some watches of this type are so designed that it is also possible to change rapidly the hour hand setting, as in the case when the user is travelling between time zones. One construction involves selecting the information to be corrected, hours and minutes or only hours, by rotating the stem in one direction or the other, while keeping it in its pushed-in position, pulling the stem out, and then turning it again to correct the selected information, the rotary movement of the stem in one direction or the other then making it possible to turn the watch forwards or backwards.

Such correction systems require relatively complicated mechanisms which in most cases involve a high degree of precision and are therefore expensive. In addition, such mechanisms are bulky.

Moreover, as the electronic correction of time information by means of pushbuttons in digital display watches suffered from disadvantages, in particular the disadvantage of requiring complicated operating movements which do not intuitively spring to mind, the attempt was made to replace such control members by a time setting stem to which the users of watches were more accustomed. Various designs using a rotary control stem have been proposed. One such design comprises, as in the case of electromechanical watches, using a control stem which has two axial positions, and rotating the stem in one direction or the other, in the position in which it is pulled out, in order simultaneously to correct minutes and hours in two directions, the speed of correction depending on the speed of rotation of the stem. This design suffers from disadvantages. In actual fact, either the time setting operation is carried out at a rate which makes it possible to watch the minutes display, in which case correction in respect of hours is slow, or else the time setting operation is carried out at a rapid rate, although in that case it is difficult to watch the minutes units in order to stop the correction operation at the desired moment. Moreover, there is the danger of losing the time, when correction in respect of time zone is effected.

Other known digital watches comprise a winder crown which, when it is pulled out, permits correction in respect of hours or minutes, in response to a rotary movement of the crown in one direction or the other.

This method suffers from the same disadvantages as the design described above, for different reasons. The correction operation is a slow one since it can be carried out only in one direction. The danger of losing the time is because it is difficult for the user of the watch to know in what direction the crown is in fact rotated, particularly when beginning the operation.

It is also known for the hours display and the minutes display to be altered by rotating the time setting stem at a slow speed or at a high speed respectively, the display moving forwards or backwards depending on the direction of rotation. Such a design does not eliminate the danger of losing the time.

SUMMARY OF THE INVENTION

The aim of the present invention is to provide a watch wherein correction in respect of time information is effected rapidly by a simple and intuitive procedure, eliminating the possibility of losing the time due to errors or incorrect movements on the part of the user and, in the case of an analog display watch, eliminating the disadvantages of the mechanical correction systems.

This aim is achieved by virtue of the fact that, in the watch according to the invention which comprises a time base for producing a standard frequency signal, a frequency divider circuit connected to said time base for producing a low-frequency time signal, time information display means capable of displaying at least hours and minutes in response to said time signal and a circuit for correcting the display, which is controlled by a manual rotary control member capable of occupying at least two axial positions, one being a rest position which is occupied by the manual control member when the watch is functioning normally and the other being an operative position for jointly correcting the minutes display and the hours display, the correction circuit is so arranged as to produce a correction in the hours display alone in response to a particular predetermined movement of the manual control member in its rest position.

The particular rotary movement which must be imparted to the manual control member in order to trigger correction of the hours display must be such that it makes an accidental alteration in the displayed time highly improbable. Such movement for the manual control member, preferably consists in rotating at least through a given minimum angle in a time interval which is less than a predetermined period.

The wearer of the watch therefore enjoys the benefit of being able to correct both the hours display and the minutes and hours display, in an easy and reliable manner, without any necessity to involve a third axial position of the manual control member, which position, if provided, can be reserved for altering other time information than hours and minutes. This is an additional advantage of the watch according to the present invention as the number of positions that can be envisaged in respect of a time setting stem is necessarily severely limited.

In a preferred embodiment of the watch, correction in respect of minutes display and hours display, or correction in respect of hours display alone, is effected in the forwards direction in response to rotary movement of the manual control member in one direction and in the backwards direction in response to rotary movement of said manual control member in the opposite direction. This makes it possible to increase the speed of correction and does not require the user to perform any operating movements other than those to which he was accustomed, with conventional mechanical or electromechanical watches.

BRIEF DESCRIPTION OF THE DRAWINGS

Other features and advantages of the invention will be more clearly apparent from the following description of a preferred embodiment, with reference to the accompanying drawings in which.

DETAILED DESCRIPTION OF THE PREFERRED EMBODIMENT

Figure 1:
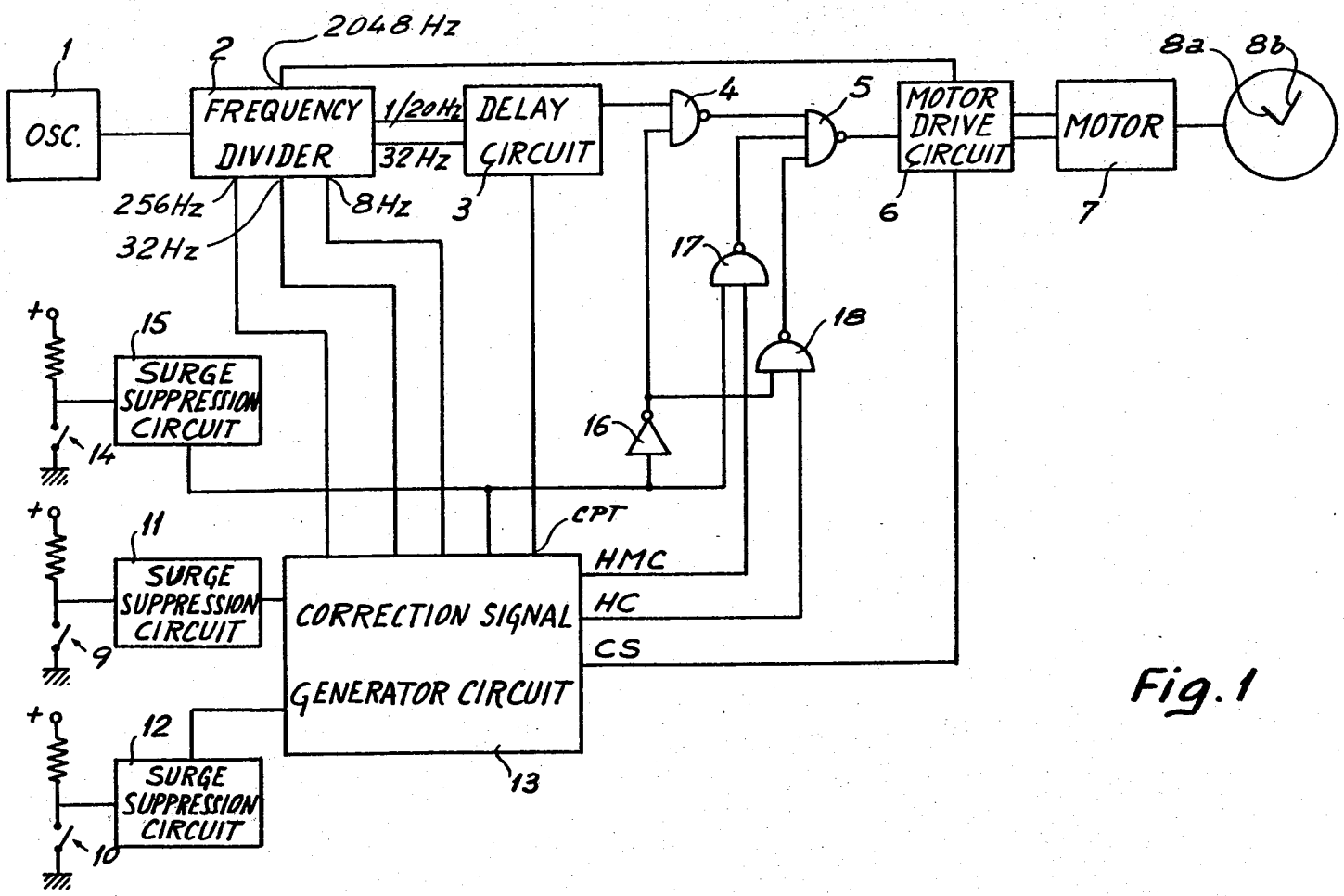
FIG. 1 is a block diagram of a preferred embodiment of an electronic watch according to the invention.

FIG. 1 is a block diagram of a preferred embodiment of an electronic watch according to the invention. This watch is of analog display type and comprises a minutes hand which normally moves forward by one step every 20 seconds and an hours hand, the hands being driven by a reversible stepping motor for permitting correction of the time information displayed in both directions, both forwards and backwards.

A time base 1 such as a quartz oscillator produces a high-frequency signal, for example at a frequency of 32 kHz, which is applied to a frequency divider circuit 2 which, in conventional manner, comprises a series of cascade-connected flip-flops and which produces a signal of normal time pulses, the frequency of which is 1/20 Hz. When the watch is operating normally, that signal is transmitted by way of a delay circuit 3, the function of which will be apparent hereinafter, and two NAND-gates 4 and 5, to a circuit 6 for driving the motor. The drive circuit is so designed as to produce, in response to the pulses applied to its input which are either the normal pulses supplied every 20 seconds by the frequency divider 2, or, as will be seen hereinafter, correction pulses, the drive pulses which are of suitable duration and polarity required to drive the reversible stepping motor 7 to which a minutes hand **8*b* and an hours hand 8*a* are mechanically coupled. Moreover, by suitably controlling the drive circuit 6**, as will be described hereinafter, it is possible for the motor to be caused to rotate in the normal direction, that is to say, the direction of forward time movement, or in the backwards direction.

The watch also comprises a manual rotary control stem having two axial positions, one being a rest position and the other being an operative position. The stem is not shown in FIG. 1. When the stem rotates in one or other of its positions, it actuates two mechanical switches 9 and 10 which generate two signals which are each formed by a succession of pulses having a frequency which is proportional to the speed of rotation of the control member and which are out-of-phase with respect to each other, the sign of this phase difference being dependent on the direction of rotary movement. Those two signals are transmitted by way of surge-suppression circuits 11 and 12 to a correction signal generator circuit 13.

A third switch 14 which is actuated by the control stem when it is displaced axially produces a logic signal representative of the position occupied by the stem. That signal, which is of value "0" or "1" depending on whether the stem is in its rest position or its operative position respectively, is applied by way of surge-suppression circuit 15 to the correction signal generator circuit 13 and to one of the two inputs of a NAND-gate 17, the output of which is connected to an input of the NAND-gate 5. That signal is also applied by way of an inverter 16 to an input of the NAND-gate 4 and to one of the two inputs of another NAND-gate 18, the output of which is connected to a third input of the NAND-gate 5.

The correction signal generator circuit 13 is so designed as to produce, from the signals that it receives from the switches 9, 10 and 14 and various signals taken off at the outputs of intermediate stages of the frequency divider 2, two correction pulse signals HMV and HC and a correction direction control signal CS.

The first correction pulse signal HMC which is intended to permit a change in the minutes display and at the same time the hours display is generated in response to any rotary movement of the control stem and is formed by a succession of pulses, the frequency of which depends on the speed of rotation of the stem. In contrast, the second correction pulse signal HC which is produced in order to permit correction of the display of hours alone, is supplied by the correction signal generator circuit 13 only in response to a particular rotary movement of the control stem; in the embodiment described herein, that particular direction through a certain angle in an interval of time which is less than a predetermined value, more precisely two turns in less than two seconds. The signal HC comprises a train of pulses, the frequency of which, selected as 32 Hz in this embodiment, is very higher than that of the pulses which are normally supplied by the frequency divider 2. The number of such correction pulses is equal to the number of steps that must be performed by the minutes hand in order to make a complete revolution, that is to say, 180, unless the wearer of the watch makes use of the possibility of converting the time zone correction mode into a rapid minutes display correction mode in the manner which will be described hereinafter. When the correction signals HMC and HC are produced, they are respectively applied to the second inputs of the NAND-gates 17 and 18.

The correction direction control signal CS makes it possible to control the drive circuit 6 so as to cause the stepping motor to rotate in the forwards direction or in the backwards direction, depending on whether the user of the watch turns the control stem in one direction or the other, to alter the time display. The signal CS remains at logic level "0" except when the stem is turned in the backwards direction; in that case, it goes to logic level "1" and remains at that level during the duration of the correction operation.

The time taken by the minutes hand to cover one revolution, when correcting the hours display, which is of about 5.6 s, is not negligible and it may happen that, during that period, the frequency divider 2 produces a normal pulse. Blocking of that pulse would result in the time being lost, and that is not a desirable feature.

The provision of the circuit 3 makes it possible to overcome that disadvantage. This circuit, an embodiment of which will be described in detail hereinafter, is provided to memorise any normal pulse that may be delivered during the period for which the hours display correction operation lasts, until the end of that period, and then to restore that pulse at its output. For that purpose, it receives from the correction signal generator circuit 13, a counting time signal CPT indicating the moments at which the first and last pulses of the signal HC are supplied by the circuit 13.

The mode of operation of the watch shown in FIG. 1 is as follows: In normal operation, the rotary control stem is in the rest position and the signal produced by the switch 14 is at logic level "0". the frequency divider 2 and transmitted by the circuit 3. As the signal CS is then at logic level "0", the drive circuit 6 causes the motor 7 to rotate in the normal direction and the minutes hand 8*b* advances one step every 20 seconds. Moreover, the NAND-gate 17 whose input connected to the switch 14 is at logic level "0" blocks any signal HMC which could be produced by virtue of accidental rotation of the control stem. On the other hand, the NAND-gate 18 remains open, but the probability of an hours display correction signal HC being involuntarily produced is practically null.

When the user of the watch wishes to correct the minutes and hours display, he first moves the control stem into its axial operative position which is preferably a pulled-out position. The logic signal produced by the switch 14 is then at logic level "1", and the consequence of this is that the NAND-gate 4 is closed, and it no longer transmits the normal pulses to the motor drive circuit 6. The NAND-gate 18 is also closed whereas the input of the NAND-gate 17, which is connected to the switch 14, goes to logic level "1". The user then turns the control stem in one direction or the other, depending on whether he wishes to adjust his watch backwards or forwards. When the stem is rotated, the switches 9 and 10 periodically open and close and the generator circuit 13 produces the correction signal HMC as long as the user of the watch is rotating the stem. The signal is transmitted by the NAND-gates 17 and 5 to the drive circuit 6. If the stem is rotated in the forwards direction, the correction direction control signal CS is of value "0", the motor is rotated in the normal direction, and the display advances at the speed set by the user. If the stem is rotated in the opposite direction, the circuit 13 produces a signal CS which is at logic level "1", the effect of which is to cause the motor 7 to rotate in the opposite direction, thereby altering the display in the backwards direction. It should be noted that, if the user performs the correction operation by rotating the stem rapidly, one or more trains of hours display correction pulses may also appear, but those signals HC are not transmitted by the gate 18.

In order to alter the hours display, the user rapidly rotates the control stem, through two revolutions in less than 2 seconds, while keeping it in its rest position. As in normal operation, the NAND-gates 4, 5 and 18 are capable of transmitting a signal, while the gate 17 is closed. As soon as it has detected that this particular rotary movement of the stem has been made, by means which will be described in greater detail hereinafter, the correction signal generator circuit 13 begins to liberate the 180 pulses at a frequency of 32 Hz, which are required to cause the minutes hand to perform a complete revolution around the dial of the watch, thereby producing one step of the hours hand, those pulses being transmitted to the drive circuit 6. Before the first correction pulse is dispatched, the logic signal CPT changes in level, thus causing any normal pulse to be blocked by the circuit 3, for the period of time that the correction operation lasts. At the end of the 180th pulse, the signal CPT again changes its logic state and the drive circuit 6 receives from the circuit 3, a catch-up pulse, in the case where a normal pulse has been delivered by the frequency divider during the correction operation.

As in the minutes and hours correction mode, the signal CS controls the forwards or backwards movement of the display, depending on the direction of rotary movement of the stem.

The user performs the same operation the number of times required to produce the desired hours display. However, as will be seen hereinafter, in the detailed description of the generator circuit 13, another correction operation is without effect if it takes place and is finished before the last correction pulse has been delivered.

It is also possible to effect rapid correction of the minutes display by first following the same procedure as for altering the hours display, and by moving the control stem from its rest position to its operative position when the minutes hand reaches the desired position, axial movement of the stem then interrupting the transmission of the pulse signal HC through the NAND-gate 18. If necessary, the correction operation can be concluded at low speed, by then rotating the stem in its operative position. Although this is not absolutely necessary, it is also possible in addition to provide a means for interrupting the despatch of the 32 Hz pulses to the input of the gate 18 when changing the position of the stem. Such means will be described hereinafter.

Figure 2:
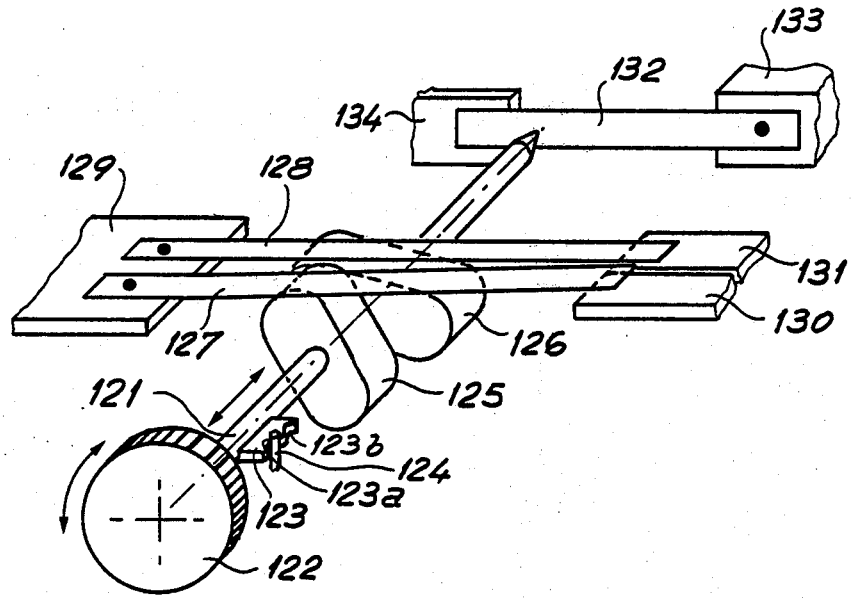
FIG. 2 is a schematic view of an embodiment of switching means for converting the movements of the manual control member into electrical signals.

FIG. 2 shows a possible arrangement of the switching means 9, 10 and 14 in FIG. 1.

The rotary control stem which is denoted by reference 121 is guided axially in the case body (not shown) of the watch and is provided at its end which is outside the watch case, with an actuating crown 122. Fixed to the stem 121 is a resilient element 123 having two notches 123*a* and 123*b* which can successively receive a pin 124 which is fixed in the case of the watch. This arrangement 123 and 124 permits the stem 121 to be set in two stable predetermined axial positions. The stem 12 carries two identical cams 125 and 126 which are of substantially elliptical shape and which are out-of-phase relative to each other at about 45°. Each cam 125 and 126 co-operates with a respective electrically conducting resilient strip 127 and 128, one end of which is fixed to an electrically conducting member 129 which is electrically connected to the case of the watch and the other end of which can be successively applied to and moved away from respective fixed contacts 130 and 131 which are electrically connected to the positive terminal of the electrical power supply source of the watch.

Each strip 127 and 128 and the fixed contacts 130 and 131 which are respectively associated therewith correspond to one of the switches 9 and 10 shown in FIG. 1. Such a device supplies two pulses per turn of the stem, for each contact 130 and 131. The phase difference between the pulses produced by the switch 27, 130 and those produced by the switch 128, 131 corresponds to the angle between the two cams 125 and 126.

The switching device shown in FIG. 2 further comprises an electrically conducting resilient strip 132 which is disposed at the end of the stem 121 and which has one end fixed to a member 133 which is electrically connected to the case, forming earth. When the stem 121 is in the pushed-in axial position, or rest position, the end thereof bears against the strip 132 and holds the free end thereof applied against a fixed contact 134 which is electrically connected to the positive terminal of the supply voltage source of the watch while when the stem is in the pulled-out position, or operative position, the strip 132 remains spaced from the fixed contact. The strip 132 and the contact 134 form the switching means 14 in FIG. 1.

Figure 3:
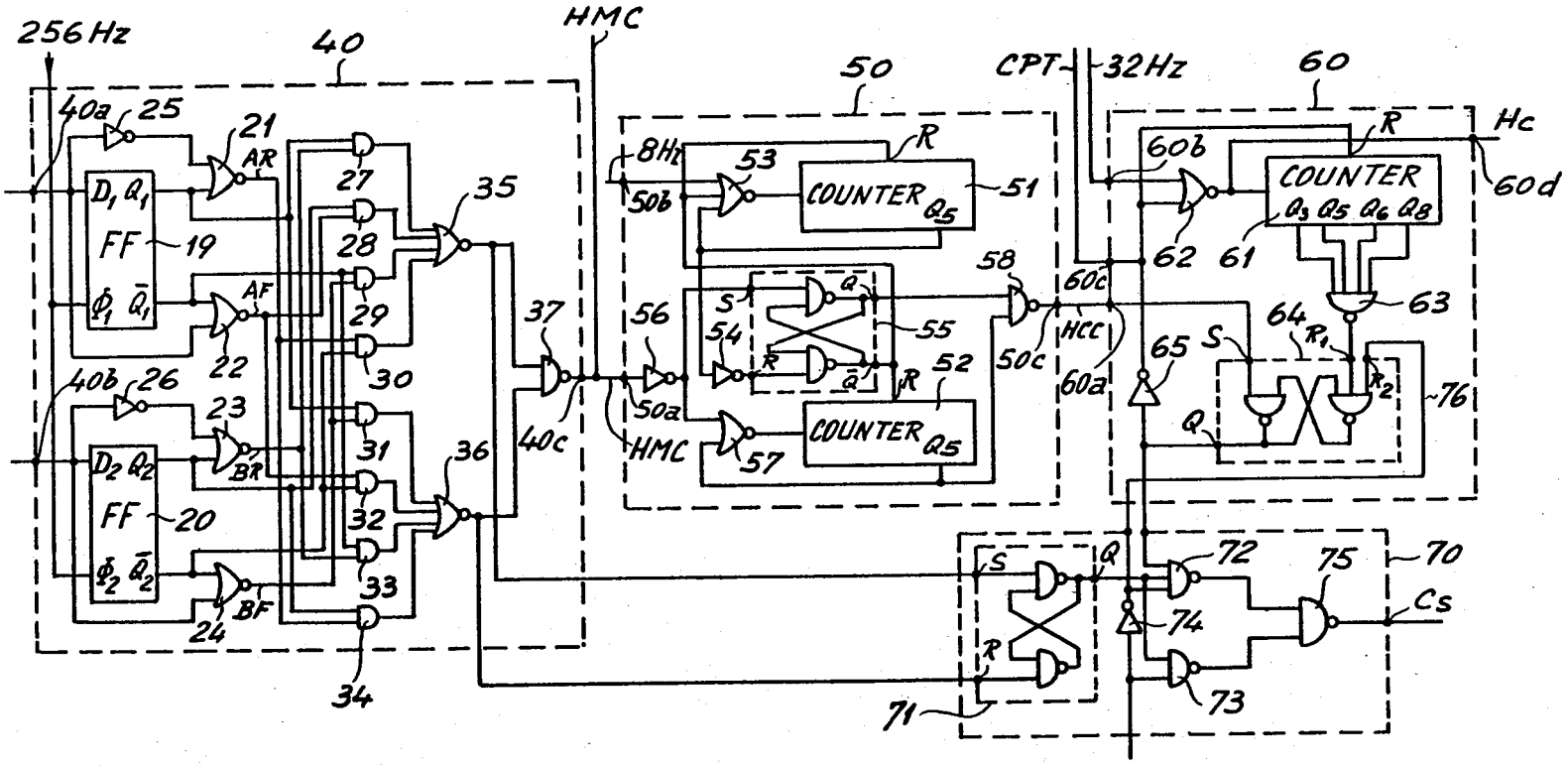
FIG. 3 is a block diagram of an embodiment of the correction signal generator circuit used in the circuit of FIG. 1, FIGS. 4 and 5 are timing charts for illustrating the operation of the circuit shown in FIG. 3.

FIG. 3 is a diagram of an embodiment of the correction signal generator circuit 13 (see FIG. 1) which is provided to be associated with the switching arrangement shown in FIG. 2. This circuit 13 comprises a circuit 40 which, at its inputs 40*a* and 40*b*, receives the out-of-phase signals from the switches 9 and 10 (FIG. 1) and which produces therefrom the first correction pulse signal HMC, the frequency of which is proportional to the speed of rotary movement of the control stem and which appears at its output 40*c*, a discriminator circuit 50 which is intended to produce a signal for controlling correction of the hours display, when the rotary stem is rotated through two revolutions in less than 2 seconds, a counting circuit 60 for supplying, in response to the control signal produced by the discriminator circuit, the 180 pulses required for correcting the time zone, and a circuit 70 for producing the correction direction control signal CS applied to the stepping motor drive circuit.

The circuit 40, the inputs 40*a* and 40*b* of which are respectively connected to the surge-suppression circuits 11 and 12 (see FIG. 1) comprises two D-type flip-flops 19 and 20, the inputs $D_1$ and $D_2$ of which are respectively connected to the inputs 40*a* and 40*b*, and which receive at their clock inputs $\phi_1$ and $\phi_2$ the same signal at a given frequency, for example 256 Hz, from an intermediate output of the frequency divider circuit. It should be noted that, when the surge-suppression circuits are each formed in known manner by two cascade-connected D-type flip-flops, the flip-flops 19 and 20 may be the second flip-flops of those circuits. The output $Q_1$ of the flip-flop 19 is connected to one of the two inputs of a NOR-gate 21, the other input of which is connected to the input 40*a* of the circuit by way of an inverter 25. That input is also connected to one of the inputs of a second NOR-gate 22, the other input of which is connected to the complementary output $\overline{Q_1}$ of the flip-flop 19.

In the same manner, the outputs $Q_2$ and $\overline{Q_2}$ of the flip-flop 20 are respectively connected to first inputs of the NOR-gates 23 and 24. The second input of the gate 23 is connected by way of an inverter 26 to the input 40*b* of the circuit, while the second input of the gate 24 is connected directly to the same input 40*b*. The circuit 40 also comprises eight two-input AND-gates 27 to 34. The inputs of the gate 27 are connected to the output $\overline{Q_1}$ of the flip-flop 19 and to the output of the NOR-gate 23, the inputs of the gate 28 are connected to the output $Q_2$ of the flip-flop 20 and to that of the NOR-gate 22, the outputs of the gate 29 are connected to the output $\overline{Q_1}$ of the flip-flop 19 and to that of the gate 24 and those of the gate 30 are connected to the output $Q_2$ of the flip-flop 20 and to the output of the gate 21. Likewise, the inputs of the gates 31, 32, 33 and 34 respectively receive the signals from the output $Q_1$ and the gate 24, the output $Q_2$ and the gate 21. The outputs of the AND-gates 27 to 30 are connected to the four inputs of a NOR-gate 35 while the outputs of the gates 31 to 34 are connected to the four inputs of a NOR-gate 36. The outputs of the gates 35 and 36 supply the two inputs of a NAND-gate 37, at the output of which appears the correction pulse signal HMC.

Figure 4:
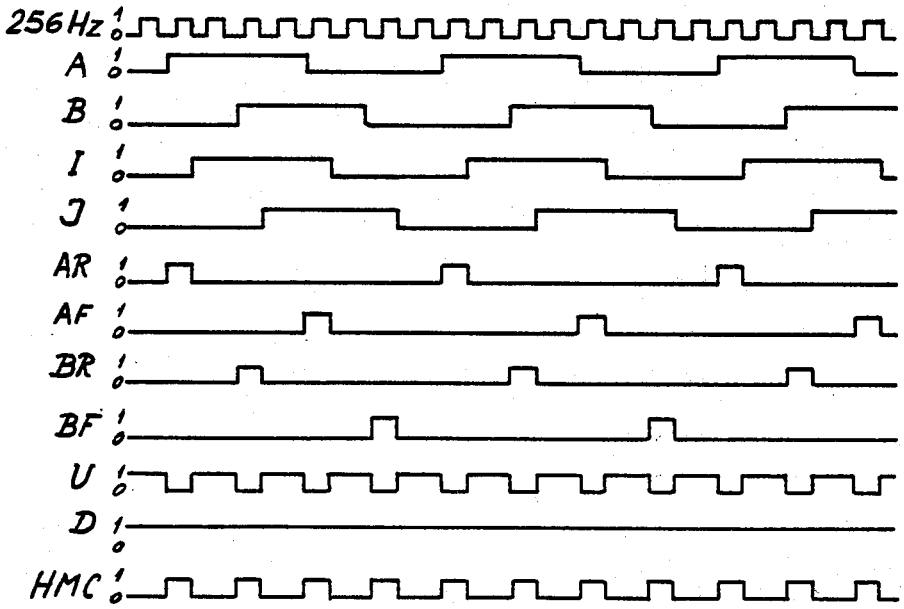

The mode of operation of the circuit 40 is illustrated by the diagram shown in FIG. 4. In FIG. 4, the signals A, B are those which appear at the inputs 40*a* and 40*b* and which correspond to the switching pulses produced by the switches 9 and 10 (see FIG. 1). The signals I and J are those produced by the outputs $Q_1$ and $Q_2$ of the flip-flops 19 and 20 while the signals AR, AF, BR, BF, U and D are those which respectively appear at the outputs of the gates 21, 22, 23, 24, 35, and 36.

Let it be assumed that initially the inputs 40*a* and 40*b* of the circuit are at logic level "0", and likewise in regard to the outputs $Q_1$ and $Q_2$ of the flips-flops 19 and 20. The outputs of the NOR-gates 21 to 24 are then at logic level "0", and also the outputs of the AND-gates 27 to 34. The outputs of the NOR-gates 35 and 36 are consequently at logic level "1". The arrival of a switching pulse at the input $D_1$ from level "0" causes the output $Q_1$ to go to logic level "1" with a slight delay because the $Q_1$ output changes level only at the end of the first clock pulse following the change of the input $D_1$ from level "0" to level "1". On the other hand, the change of signal A from logic level "0" to level "1" opens the gate 21 which is closed again when the $Q_1$ output goes to level "1" during the period of time taken by the flip-flop 19 to change its state. While the output of the gate 21 is at level "1", the AND-gate 30 is open, and the effect of this is to close the NOR-gate 35. The other AND-gate 34, one input of which is connected to the output of the NOR-gate 21, remains closed because the $Q_2$ output of the flip-flop 20 remains at level "0". The output of the gate 36 therefore remains at level "1". A pulse therefore appears at the output of the NAND-gate 37.

The same thing happens when the switching pulse from the surge-suppression circuit 12 reaches the input $D_2$ of the flip-flop 20. The gates concerned this time are the NOR-gate 23 and the AND-gate 27 which closes the gate 35 for a period of time which is equal to the switching time of the flip-flop 20. Therefore, a second pulse appears at the output of the NAND-gate 37.

At the end of the switching pulse A, the output $Q_1$ again goes from level "1" to level "0" and the complementary output $\overline{Q_1}$ goes from level "0" to level "1". This time it is the NOR-gate 22 which is open for the flip-flop switching time and which, by way of the AND-gate 28, closes the gate 35, with the consequence of causing a fresh pulse to appear at the output of the gate 37. In the same way, a pulse appears at that same output at the end of the switching pulse from the surge-suppression circuit 12, due this time to the gates 24 and 29. Therefore, when the control stem rotates in one direction, the result is a train of pulses at the output of the NAND-gate 37, which forms the correction signal HMC and which is the inverse of the signal U produced at the output of the NOR-gate 35, the output of the gate 36 remaining at level "1".

An identical piece of description would show that, if the rotary stem were rotated in the opposite direction, that is to say, if the signal B were ahead of signal A, the correction pulses HMC would come from the signal supplied by the gate 36, in which case the output of the gate 35 would remain at level "1".

The number of correction pulses produced per revoulution of the control stem is 8.

The correction pulse signal HMC is transmitted to an input 50*a* of the discriminator circuit 50 which comprises two counters 51 and 52, each having a capacity of 32. The input of the counter 51 is connected to the output of a NOR-gate 53, a first input of which is connected to another input 50*b* of the discriminator circuit 50, to which input there is applied an 8 Hz reference signal originating from the frequency divider.

The $Q_5$ output of the counter 51 is connected on the one hand to a second input of the NOR-gate 53 and on the other hand, by way of an inverter 54, to the R input of a R-S-type flip-flop 55, the S input of which is connected to the input 50*a* of the circuit, by way of an inverter 56. The complementary output $\overline{Q}$ of that flip-flop is connected to the reset inputs, R, of the counters 51 and 52, and to a third input of the NOR-gate 53. The output of the inverter 56 also feeds a first input of the NOR-gate 57, the output and the second input of which are respectively connected to the input and the $Q_5$ output of the counter 52. Finally, the circuit 50 comprises a NAND-gate 58, the two inputs of which are connected respectively to the Q output of the flip-flop 55 and to the $Q_5$ output of the counter 52, the output of that gate forming the output 50*c* of the discriminator circuit.

Before the wearer of the watch who wishes to alter the time rotates the control stem, the flip-flop 55 is in the the rest state. The output of the NAND-gate 58 is accordingly at level "1". The counters 51 and 52, each having their R input at level "1", are at zero. The NOR-gate 53, the third input of which is at level "1", is closed, while the NOR-gate 57 is open.

The arrival of the first pulse of the signal HMC resulting from rotary movement of the stem causes the flip-flop 55 to switch over; the change of the $\overline{Q}$ output of the flip-flop from level "1" to level "0" frees the counters 51 and 52 and opens the NOR-gate 53. The output of the gate 58 remains at level "1". The 8 Hz signal and the signal HMC are transmitted to the inputs of the counters 51 and 52 respectively. A number of situations may then arise: if the user rotates the control stem through two revolutions in less than 2 seconds, the $Q_5$ output of the counter 51 also goes to level "1". The effect of this is on the one hand to close the gate 57 and therefore interrupt the application of the signal HMC to the input of the counter 52 and, on the other hand, to cause the output of the gate 58, the two inputs of which are then at level "1", to go to level "0". That level is maintained until the $Q_5$ output of the counter 51 also goes to level "1". At that moment, the NOR-gate 53 closes while the $\overline{R}$ input of the flip-flop 55 goes to level "0" and its Q and $\overline{Q}$ outputs respectively go to levels "0" and "1", the result of which is to cause the output of the NOR-gte 58 again to go to level "1". An hours display correction control signal HCC has therefore appeared at the output 50*c* of the discriminator circuit. Return of the flip-flop 55 to its rest state also causes the counter 51 and 52 to be reset. The NOR-gate 57 accordingly becomes open again while the NOR-gate 53 which has its second input go to level "0" but its third input go to level "1" remains closed.

If the user continues to turn the control stem, the following pulse applied to the input 50*a* of the circuit will cause a change in the state of the flip-flop 55, and liberation of the counters 51, 52 and the gate 53. If the stem is again rotated through two turns in less than 2 seconds, the discriminator circuit 50 will operate in the same manner and a fresh signal HCC will be produced, or else the arrangement will again be in one of the following situations.

If the stem is rotated through two turns in more than 2 seconds, the circuit 50 initially operates in the same manner as described above, except that in this case it is the $Q_5$ output of the counter 51 which goes to logic level "1" before that of the counter 52, thereby causing closure of the gate 53, switching of the flip-flop 55 and consequently resetting of the two counters. The NOR-gate 57 remains open but the following pulse of the signal HMC which immediately follows the $Q_5$ output of the counter 51 going to level "1" causes the flip-flop 55 to switch back into its operative state and the circuit 50 begins again to count the pulses that it receives. In that case, the $Q_5$ output of the counter 52 remains at level "0". In consequence, no signal HCC appears at the output 50*c* which remains in state "1".

The discriminator circuit operates in the same fashion when the stem does not make two complete turns.

It should be noted that, in order to produce the same result, it would also be possible for the input 50*a* of the discriminator circuit to be connected directly to the output of one or other of the surge-suppression circuits 11 and 12 (see FIG. 1) and to use a 2 Hz reference signal, in which case, the counters 51 and 52 can be replaced by counters having a counting capacitor of only 8.

The output 50*c* of the discriminator circuit is connected to the input 60*a* of the counting circuit 60 which, at another input 60*b*, receives an inverted 32 Hz signal coming from the frequency divider 2. The circuit 60 comprises a counter 61, the capacity of which is 256 and the input of which can receive the 32 Hz signal by way of a NOR-gate 62, a first input of which is connected to the input 60*b* of the circuit. The $Q_3$, $Q_5$, $Q_6$, $Q_8$ outputs of the counter 61 supply the four inputs of a NAND-gate 63, the output of which is connected to a reset input $R_1$ of a R-S type flip-flop 64; the S input of the flip-flop 64 is connected to the input 60*a* of the circuit while the Q output of the flip-flop is connected by way of an inverter 65, on the one hand to a second input of the NOR-gate 62 and on the other hand, to the reset input R of the counter 61.

As long as the input 60*a* of the circuit remains at level "1", the NOR-gate 62 remains closed and the counter 61 is held at zero, the Q output of the flip-flop then being at level "0". When that input goes to level "0", the flip-flop 64 switches over, enabling the counter 61 and opening the gate 62 which transmits the 32 Hz signal, while inverting it, to the output 60*d* of the circuit, which is connected to the output of the NOR-gate 62. The pulses are counted by the counter 61. At the end of the 180th pulse, the $Q_3$ output goes to level "1"; the $Q_5$, $Q_6$ and $Q_8$ outputs are already at that level. The change in the NAND-gate 63 from level "1" to level "0" causes the Q output of the flip-flop 64 to go to level "0" and the NOR-gate 62 ceases to transmit the 32 Hz pulses to the counter and to the output 60*d* of the circuit.

Figure 5:
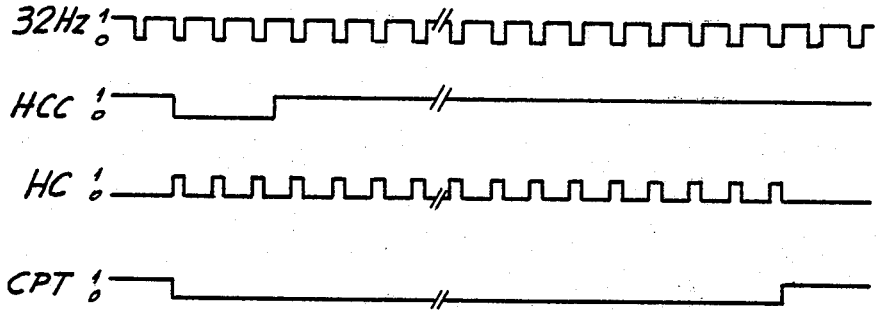

FIG. 5 shows the inverted 32 Hz signal and the correction control signal HCC applied to the counting circuit, as also the hours display correction signal HC which is supplied thereby. The signal CPT which is also shown in FIG. 5 is the signal which is applied to the second input of the NOR-gate 62 and which is also passed to the circuit 3 (see FIG. 1).

It should be noted that, if a fresh correction control signal HCC appears at the input 60*a* of the circuit before the 180 pulses at a frequency of 32 Hz have been counted, that signal will have no effect, and the flip-flop 64 remains in the same state. The user of the watch will have to wait for the forwards or backwards movement of the display by one hour to be terminated before again rotating the stem through two revolutions in less than 2 seconds if he wishes to continue with correction or at least terminate that operation only after the counting circuit has released the last pulse.

The circuit for producing the correction direction logic signal CS comprises a R-S type flip-flop 71, the inputs S and R of which are respectively connected to the outputs of the NOR-gates 35 and 36 of the circuit 40 and three NAND-gates 72, 73 and 75. The gate 72, of which first and second inputs are respectively connected to the Q output of the flip-flop 71 and, by way of an inverter 74, to the output of the surge-suppression circuit 15 associated with the switch 14 (see FIG. 1), receives on a third input, the signal which appears at the output of the flip-flop 64 of the counting circuit 60 and which is the inverse of the counting signal CPT. The gate 73 also has an input connected to the output of the flip-flop 71 and another connected directly to the surge-suppression circuit 15. The outputs of the gates 72 and 73 feed the two inputs of the gate 75, at the output of which appears the signal CS. Assuming that the Q output of the flip-flop 71 is at level "0" when the control stem is or has last been returned in the direction of forwards movement of the display, and at level "1" in the case of rotation in the opposite direction, the circuit 70 will produce a signal CS which will always be of value "0" except when the control stem is in its operative position and is rotated in the direction of backwards movement of the display, and for the period of time taken by the time zone correction operation, possibly, rapid correction in respect of the minutes display when that alteration is also effected in the backwards direction of the display.

FIG. 3 also shows that the gate of the flip-flop 64, the input of which is connected to the NAND-gate 63, has another input $R_2$ which is connected by the inverter 74 of the circuit 70 to the output of the surge-suppression circuit 15. The connection 76 serves to interrupt the transmission by the 32 Hz pulse counting circuit to the motor drive circuit when the user performs a rapid minutes display correction operation, in the manner described hereinbefore.

Figure 6:
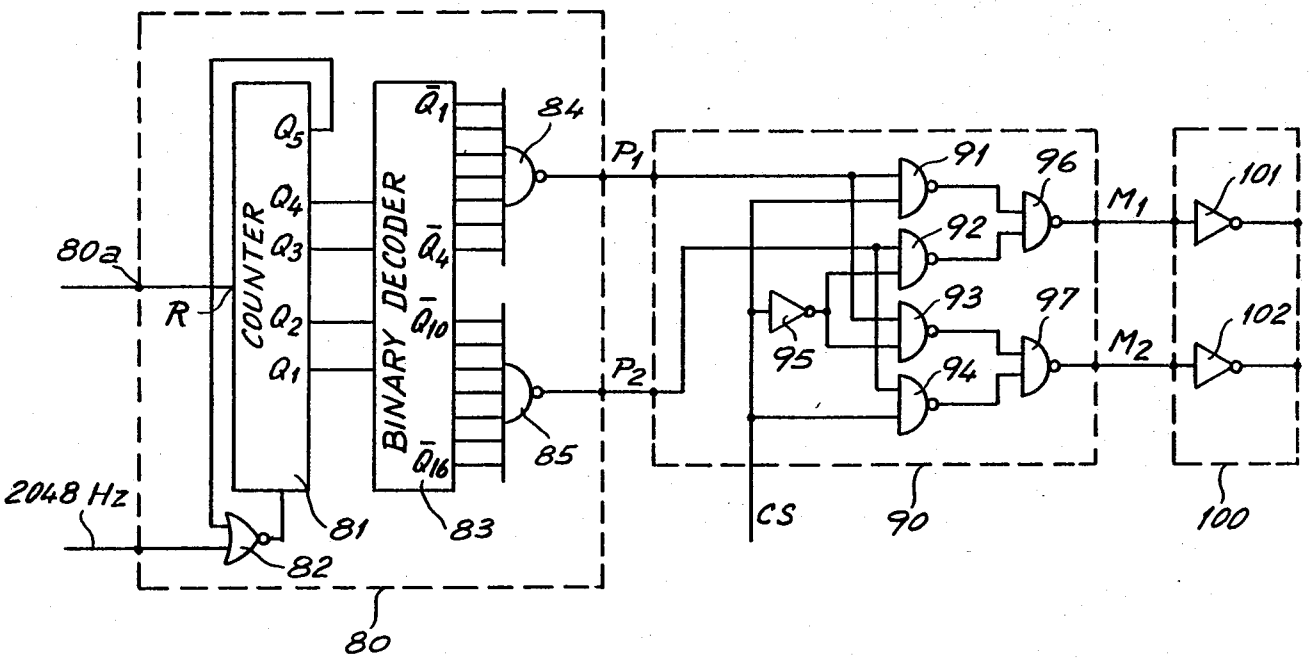
FIG. 6 is a block diagram of an embodiment of a circuit for driving the stepping motor of the watch shown in FIG. 1.

A possible embodiment of the stepping motor drive circuit 6 will now be described with reference to FIGS. 6 and 7. The circuit comprises a pulse shaping circuit 80, a circuit 90 for controlling the direction of rotation of the motor, and a supply circuit 100.

The shaping circuit 80, the function of which is to produce the pulses of a given duration, which are required to control the drive of the stepping motor, in response to normal or correction pulses applied to its input 80*a*, comprises a counter 81 having a counting capacity of 32, with its input connected to the output of a NOR-gate 82. The gate 82 receives, at one of its inputs, which is connected to an intermediate stage of the frequency divider 2 (see FIG. 1), a periodic signal at a frequency of 2048 Hz and has its other input connected to the $Q_5$ output of the counter 81, the $Q_1$ to $Q_4$ outputs of which feed the four inputs of an entirely conventional sixteen-output binary decoder 83. The pulse shaping circuit also comprises two seven-input NAND-gates 84 and 85. The first seven complementary outputs $\overline{Q}_1$ to $\overline{Q}_7$ of the decoder 83, are connected to the inputs of the gate 84, while the last seven $\overline{Q}_{10}$ to $\overline{Q}_{16}$ are connected to the inputs of the gate 85.

Each pulse which appears at the input 80*a* of the circuit, which is connected to the R input of the counter, provides for zero resetting thereof, thereby causing opening of the gate 82, which was previously closed and which then transmits the 2048 Hz signal to the input of the counter. When the content of the counter reaches the value 16, the $Q_5$ output thereof goes again to state "1", thereby closing the gate 82 until a fresh pulse arrives at the input 80*a*. The period of time for which the 2048 Hz signal is applied to the input of the counter 81 is about 7.8 ms, that is to say, sixteen times the period of that signal, which is substantially equal to 0.5 ms. During this counter incrementation period, the $\overline{Q}_1$ to $\overline{Q}_{16}$ outputs of the decoder 83 which initially were all at state "1" each go in turn to state "0", to return to level "1 " o.5 ms later. The signals $P_1$ and $P_2$ which appear at the outputs of the NAND-gates 84 and 85 are therefore each formed by pulses at the same frequency as the signal applied to the input 80*a* of the shaping circuit and the duration of which is substantially equal to 3.4 ms. Those two signals which are shown in FIG. 7 at the same time as the signal applied to the input 80*a* are also out of phase by about 4.4 ms, the signal $P_1$ being ahead of the signal $P_2$. The circuit 90 for controlling the direction of rotation of the motor comprises four two-input NAND-gates 91–94, the first gate 91 receiving the signal $P_1$ and the rotation direction control signal CS from the correction signal generator circuit, the second gate 92 receiving the signal $P_2$ and the signal CS inverted by an inverter 95, the third gate 93 receiving the signal $P_1$ and the inverted signal CS and the fourth gate 94 receiving the signals $P_2$ and CS. The circuit 90 also comprises two other NAND-gates 96 and 97, the gate 96 having its inputs connected to the outputs of the gates 91 and 92 and the other gate 97 having its inputs connected to the outputs of the gates 93 and 94.

Figure 7:
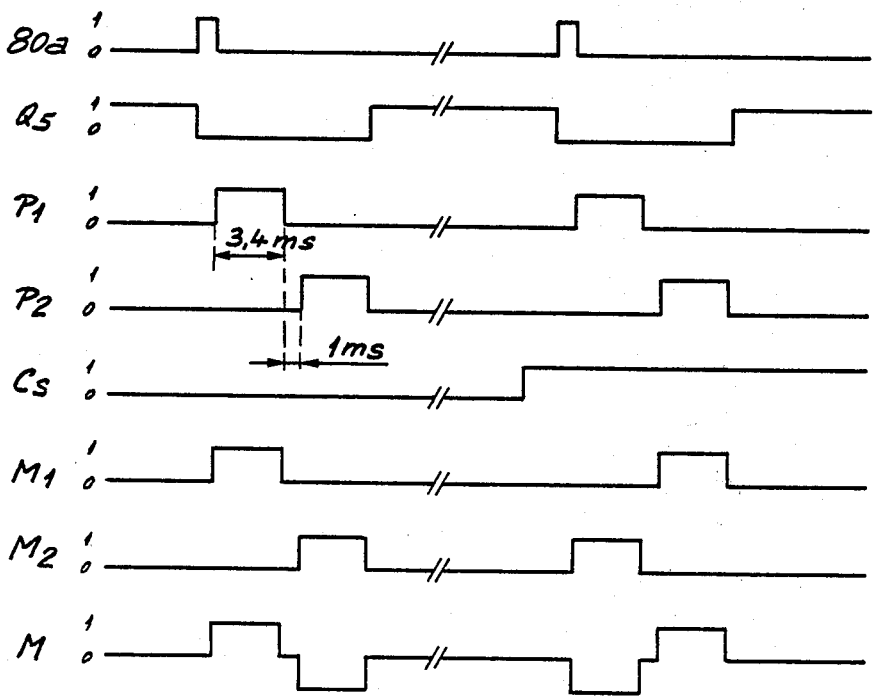
FIG. 7 is a timing chart illustrating the operation of the circuit shown in FIG. 6.

There is no need for the mode of operation of such a circuit to be described in detail, to see that, as shown in FIG. 7, the control signals $M_1$ and $M_2$ which appear at the outputs of the gates 96 and 97 will be respectively identical to the input signals $P_1$ and $P_2$ when the signal CS is at logic level "0". On the other hand, when that signal is at logic level "1", the 3.4 ms control pulses appearing at the output of the gate 96 will lag by 4.4 ms in relation to those supplied by the gate 97. In the former case, the stepping motor will receive two successive drive pulses by way of the two inverters 101 and 102 forming the supply circuit 100, the first drive pulse being positive and the second negative, which will cause the motor to perform one step, that is to say, the rotor of the motor will perform a complete revolution in the direction corresponding to forwards movement of the hands, while, in the second case, the motor will receive a negative pulse and then a positive pulse, which will cause it to rotate in the backwards direction of the display, for each pulse applied to the input 80*a* of the shaping circuit 80, as shown by the signal M in FIG. 7.

Figure 8:
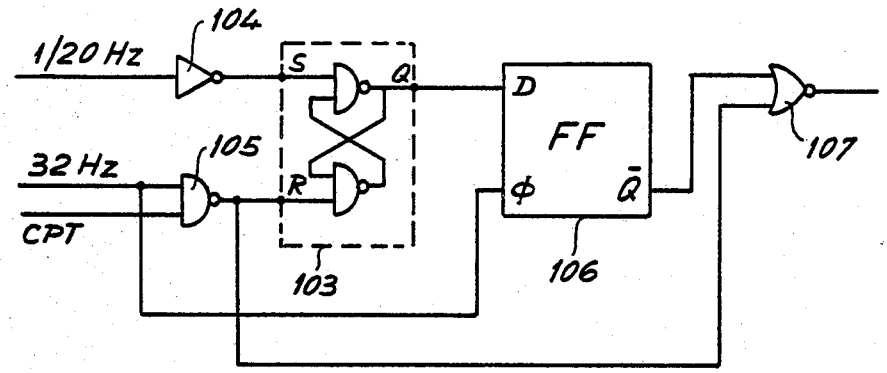
FIG. 8 is a block diagram of an embodiment of a time delay circuit used in the circuit shown in FIG. 1.

FIG. 8 shows a possible embodiment of the circuit 3 (see FIG. 1). The circuit comprises a R-S flip-flop 103 which, at its S input, receives the signal comprising normal pulses at a frequency of 1/20 Hz, which is supplied by the frequency divider, being inverter by an inverter 104. The R input of the flip-flop is connected to the output of a NAND-gate 105 which receives at its inputs a 32 Hz clock signal from the frequency divider and the counting time signal CPT. The Q output of the flip-flop feeds the D input of a D-type flip-flop 106, the clock input $\phi$ of which receives the 32 Hz signal. The complementary output $\overline{Q}$ of the D-type flip-flop is connected to an input of a NOR-gate 107, the other input of which receives the signal applied to the R input of the flip-flop 103. The gate output forms the output of the circuit 3.

Figure 9:
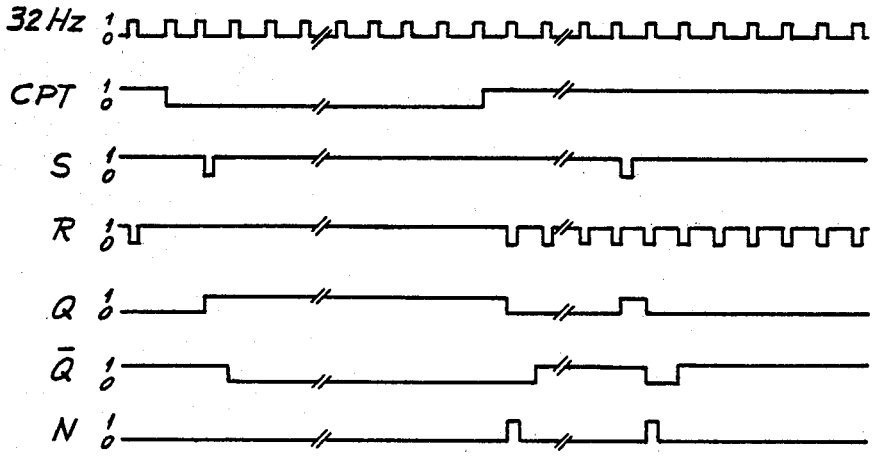
FIG. 9 is a timing chart illustrating the operation of the circuit shown in FIG. 8.

In normal operation and in the absence of a normal pulse applied to the inverter 104, the S input of the flip-flop 103 is at logic level "1" while its R input receives the 32 Hz signal which is inverted by way of the NAND-gate 105, of which the input which receives the signal CPT remains at level "1". The flip-flop 103 remains in its rest state; its Q output is at state "0" while the Q output of the D-type flip-flop is at logic level "1", thus closing the NOR-gate 107 which does not transmit the inverted 32 Hz signal. The arrival of a normal pulse supplied by the frequency divider causes the S input of the R-S flip-flop to go to "0" for a short moment, and the flip-flop switches over. The result of this is that the D input of the flip-flop 106 is changed to level "1". The rising edge of the 32 Hz pulse immediately following the change of the D input to level "1" causes the $\overline{Q}$ output of the flip-flop 106 to go to level "0" and thus enables the NOR-gate 107. That same pulse which is transmitted by the NAND-gate 105 and the NOR-gate 107 to the output of the circuit also has the effect of returning the flip-flop 103 to its rest state. At the rising edge of the following pulse of the clock signal, the D-type flip-flop returns to its initial state, again closing the gate 107. This mode of operation is illustrated by the right-hand part of the diagram in FIG. 9 which shows, in order, the 32 Hz clock signal, the counting time signal CPT, the signals applied to the S and R inputs of the flip-flop 103, the signal at the Q output of the flip-flop 103, the signal at the $\overline{Q}$ output of the D-type flip-flop and the signal N at the output of the NOR-gate 107.

When an hours display correction operation is triggered, the logic signal CPT assumes the value "0", which causes closure of the NAND-gate 105 which no longer transmits the 32 Hz signal. This has no influence on the R-S type flip-flop 103 which remains in its rest state. When no normal pulse appears at the input of the inverter 104 for the correction period, the signal CPT goes back to value "1" at the end of that period and the clock signal is again transmitted to the R input of the flip-flop, without anything having happened. In contrast, if a normal pulse occurs during the above-indicated period, that pulse causes the R-S type flip-flop to switch over and the $\overline{Q}$ output of the D-type flip-flop 106 goes to level "0" at the rising edge of the following pulse of the clock signal. The NOR-gate 107 is then opened but, as the output of the gate 105 remains at level "1", the output of the gate 107 remains at level "0". The circuit is maintained in that state until the end of the hours correction period. At that moment, the signal CPT goes back to value "1". The pulse of the 32 Hz signal which immediately follows that change and which is then transmitted by the gate 105 returns the R-S flip-flop to its initial state. In addition, that pulse appears at the output of the NOR-gate 107. At the leading edge of the following pulse of the clock signal, the $\overline{Q}$ output of the D-type flip-flop goes to "1" again and again closes the gate 107 which will have transmitted only a single pulse. This is illustrated in the left-hand part of the diagram shown in FIG. 9. When a normal pulse appears during the hours display correction period, the motor drive circuit 6 (see FIG. 1) will therefore receive, following the 180 pulse supplied by the counting circuit 60 (see FIG. 3), a 181st pulse from the circuit 3. This therefore avoids the time being lost.

It should be noted that, when correction in respect of the hours display is converted, by axial displacement of the control stem, into rapid correction of the minutes display, the circuit 3 also produces a pulse after the signal CPT returns to value "1", but that pulse is not transmitted by the NAND-gate 4 which is then closed.

It will be appreciated that the invention is not limited to the embodiment described hereinbefore. For exampler, the switching arrangement shown in FIG. 2, for converting the rotary movements of the control stem into electrical signals, may be replaced by any other system capable of producing two out-of-phase signals from which the rotary direction signal and a minutes and hours display correction signal can be produced. The various circuits described can be formed in different ways.

The particular movement to be effected to control correction in respect of the hours display could comprise simply rotating the control stem through a given angle, for example two revolutions, without time limit. That would not very substantially increase the danger of losing the time accidentally. The discriminator circuit could then comprise only a single counter and means for resetting the counter to zero when there is a change in the direction of rotation of the stem and when the stem remains stationary for a certain period of time.

The invention also applies to watches which are provided with unidirectional motors, for example of Lavet type, which are still the most widely used motors. Altering the time displays in a single direction has the disadvantage of less speedy correction, while however enjoying the advantage of simplifying the circuits. The switching arrangement which is controlled by rotary movement of the stem no longer needs to supply two out-of-phase signals and the circuits for detecting the direction of rotation of the stem, producing a correction direction control signal and controlling the direction of rotation of the motor can then be omitted, with the other circuits obviously being consequentially adapted.

The watch according to the invention may also be of digital or pseudo-digital display type. In that case, the counting circuit 60 may be replaced by a circuit, for example a monostable circuit, which supplies only a single pulse in response to the correction control signal. The minutes and hours display correction signal which is transmitted by the gate 17 and the hours display correction signal which is transmitted by the gate 18 can then be passed respectively to a reversible minutes counter and a reversible hours counter and the correction direction control signal which is produced by a simplified circuit may be applied to the counting direction control inputs of the two counters. The time delay circuit 3 is then omitted and the normal pulses produced by the frequency divider will be transmitted by way of the NAND-gate 4 which may remain, not to the circuit for driving a motor but either to the minutes counter, in which case the frequency thereof is 1/60 Hz, or to a seconds counter at a frequency of 1 Hz if the watch is designed to display such information. Unidirectional correction can also be envisaged in this type of watch.

It is also possible to produce a watch which is provided with both an analog display means and digital display means.

Moreover, the control stem may have more than two positions, for example a third position may be reversed for correcting a date data display.

What is claimed is:

1. An electronic watch comprising a time base for producing a standard frequency signal, a frequency divider circuit connected to the time base for producing a low-frequency time pulse signal, time information display means capable of indicating at least hours and minutes in response to said time pulse signal and a circuit for correcting the display, controlled by a rotary manual control member capable of occupying at least two axial positions, one being a rest position which is occupied by said manual control member when the watch is functioning normally and the other being an operative position serving jointly to correct the display of minutes and the display of hours, said correction circuit being arranged to perform a correction of the display of hours alone in response to a particular predetermined rotary movement of said manual control member in its rest position.

2. An electronic watch according to claim 1 wherein the hours display is altered by one unit in response to said particular movement of said manual control member.

3. An electronic watch according to claim 1 wherein said particular rotary movement of said manual control member consists in rotating at least through a given minimum angle in a time interval which is less than a predetermined period.

4. An electronic watch according to claim 1 wherein correction of the minutes display and the hours display, and correction of the hours display alone, are effected in the forward direction in response to a rotary movement of the manual control member in one direction and in the backward direction in response to a rotary movement of said manual control member in the opposite direction.

5. An electronic watch according to claim 3 or claim 4 wherein said correction circuit comprises means for producing, in response to a rotary movement of said manual control member, a first correction signal which is intended to permit alteration of the minutes display and the hours display and which is formed by pulses, the frequency of which depends on the speed of rotation of said manual control member; a discriminator circuit comprising a counter for counting the pulses of said first correction signal and means for producing a signal for controlling correction of the hours display when a limit counting level is attained before the end of said predetermined period; a circuit which, in response to said correction control signal, is capable of producing a second correction signal which is intended to permit alteration of the hours display and which is formed by a predetermined number of pulses; means responsive to the axial positioning of said manual control member in said rest position and in said operative position respectively for producing a position signal whose value depends on the position occupied by said manual control member; and a gate circuit which is controlled by said position signal and which is arranged to receive and transmit selectively to said display means said time pulse signal and said first and second correction signals, said arrangement being such that transmission of said second correction signal is enabled when said signal is produced in response to a rotary movement of the manual control member in the rest position, the first correction signal then being blocked, and application to the display means of said first correction signal is permitted when said signal is produced in response to a rotary movement of the manual control member in its operative position, the transmission of said time pulse signal and said second correction signal, when it is produced, then being blocked.

6. An electronic watch according to claim 5 wherein said display means comprise a stepping motor for driving members for indicating hours and minutes and a drive circuit adapted to receive said time pulse signal and said first and second correction signals and wherein the circuit producing said second correction signal receives from the frequency divider a pulse signal at a frequency higher than the frequency of said time pulse signal and is arranged to transmit to said gate circuit, in response to said time display correction control signal, a number of pulses of said signal which is equal to the number of steps that must be performed by said minutes indicating member in order for the display of hours to be altered by one unit.

7. An electronic watch according to claim 6 wherein said gate circuit is so designed as to permit interruption in the transmission of the pulses of said second correction signal to said motor drive circuit by an axial movement of said control member from its rest position to its operative position.

8. An electronic watch according to claim 6 wherein the circuit producing said second correction signal receives said position signal and comprises means responsive to said position signal and permitting interruption in the transmission to said gate circuit of the pulses of the signal from the frequency divider by axial movement of said control member from its rest position to its operative position.

* * * * *